US011276283B2

(12) United States Patent
Pulluru et al.

(10) Patent No.: US 11,276,283 B2
(45) Date of Patent: Mar. 15, 2022

(54) METHOD FOR AUTO CONFIGURING WIRELESS SENSORS IN DIY SECURITY SYSTEMS

(71) Applicant: CARRIER CORPORATION, Palm Beach Gardens, FL (US)

(72) Inventors: Ramakrishna Pulluru, Telangana (IN); SeetapatiRao Chennapragada, Telangana (IN); Udaya Bhaskar Challa, Telangana (IN)

(73) Assignee: CARRIER CORPORATION, Palm Beach Gardens, FL (US)

( * ) Notice: Subject to any disclaimer, the term of this patent is extended or adjusted under 35 U.S.C. 154(b) by 0 days.

(21) Appl. No.: 17/058,919

(22) PCT Filed: May 9, 2019

(86) PCT No.: PCT/US2019/031431
§ 371 (c)(1),
(2) Date: Nov. 25, 2020

(87) PCT Pub. No.: WO2019/226354
PCT Pub. Date: Nov. 28, 2019

(65) Prior Publication Data

US 2021/0217283 A1 Jul. 15, 2021

(30) Foreign Application Priority Data

May 25, 2018 (IN) ..... 201811019616

(51) Int. Cl.
*G08B 13/14* (2006.01)
*G08B 25/10* (2006.01)
(Continued)

(52) U.S. Cl.
CPC ..... *G08B 13/1427* (2013.01); *G08B 25/003* (2013.01); *G08B 25/10* (2013.01); *G08B 25/14* (2013.01); *G08B 29/188* (2013.01)

(58) Field of Classification Search
CPC .. G08B 13/1427; G08B 25/003; G08B 25/10; G08B 25/14; G08B 29/188
(Continued)

(56) References Cited

U.S. PATENT DOCUMENTS 7,430,181 B1 9/2008 Hong
7,567,822 B2 7/2009 Hart et al.
(Continued)

FOREIGN PATENT DOCUMENTS

CN 104254125 A 12/2014
CN 103281674 B 10/2015
EP 3068109 B1 12/2017

OTHER PUBLICATIONS

Notification of Transmittal of the International Search Report for International Application No. PCT/US2019/031431; dated Jul. 29, 2019; Report Received Date: Aug. 9, 2019; 5 pages.
(Continued)

*Primary Examiner* — John A Tweel, Jr.
(74) *Attorney, Agent, or Firm* — Cantor Colburn LLP

(57) ABSTRACT

A method of determining a location of one or more sensors in a security system is provided. The method including: detecting a first wireless signal from a first sensor; determining a first signal strength of the first wireless signal; associating the first signal strength of the first wireless signal with a first location; detecting a second wireless signal from the first sensor; determining a second signal strength of the second wireless signal; associating the second signal strength of the second wireless signal with the second location; detecting a first sensor trigger using the first sensor;
(Continued)

and determining that the first sensor trigger occurred at the second location.

16 Claims, 3 Drawing Sheets

(51) Int. Cl.
*G08B 25/00* (2006.01)
*G08B 25/14* (2006.01)
*G08B 29/18* (2006.01)

(58) Field of Classification Search
USPC ..... 340/539.23
See application file for complete search history.

(56) References Cited

U.S. PATENT DOCUMENTS

| | | | | |
|---|---|---|---|---|
| 7,840,353 | B2 | 11/2010 | Ouksel et al. | |
| 8,531,294 | B2 * | 9/2013 | Slavin | G08B 13/2462 340/568.1 |
| 8,934,855 | B2 | 1/2015 | Gale et al. | |
| 9,575,477 | B2 | 2/2017 | Blount et al. | |
| 9,659,474 | B1 | 5/2017 | Kashyap et al. | |
| 9,763,054 | B2 * | 9/2017 | Kong | H04W 40/246 |
| 10,181,256 | B2 * | 1/2019 | Wu | G08B 25/10 |
| 2010/0289644 | A1 | 11/2010 | Slavin et al. | |
| 2015/0052578 | A1 | 2/2015 | Yau et al. | |
| 2015/0319046 | A1 | 11/2015 | Plummer et al. | |
| 2016/0011751 | A1 | 1/2016 | Moses et al. | |
| 2017/0055104 | A1 | 2/2017 | Wegelin et al. | |
| 2017/0055131 | A1 | 2/2017 | Kong et al. | |
| 2017/0137047 | A1 | 5/2017 | Kim et al. | |
| 2017/0270776 | A1 | 9/2017 | Wu | |

OTHER PUBLICATIONS

Seong-Min Kim; "IoT Home Gateway for Auto-Configuration and Management of MQTT Devices"; 2015 IEEE Conference on Wireless Sensors; Department of Multimedia Engineering, Hanbat National University; 2015; 12-17 pages.

Written Opinion of the Internationa Searching Authorithy for International Application No. PCT/US2019/031431; dated Jul. 29, 2019; Report Received Date: Aug. 9, 2019; 8 pages.

* cited by examiner

METHOD FOR AUTO CONFIGURING WIRELESS SENSORS IN DIY SECURITY SYSTEMS

CROSS-REFERENCE TO RELATED APPLICATIONS

This application is a National Stage Application of International Application No. PCT/US2019/031431 filed May 9, 2019, which claims the benefit of Indian Application No. 201811019616 filed May 25, 2018, the disclosures of which are incorporated herein by reference in their entirety.

BACKGROUND

The subject matter disclosed herein generally relates to the field of security systems, and more particularly to an apparatus and method for configuring security systems.

Existing securities systems, once installed, may not be altered or reconfigured by an end user. In order to reconfigure current security systems, an end user must contact the installer of the security system to return and reconfigure the system, which limits the use and flexibility of the security system.

BRIEF SUMMARY

According to an embodiment, a method of determining a location of one or more sensors in a security system is provided. The method including: detecting a first wireless signal from a first sensor; determining a first signal strength of the first wireless signal; associating the first signal strength of the first wireless signal with a first location; detecting a second wireless signal from the first sensor; determining a second signal strength of the second wireless signal; associating the second signal strength of the second wireless signal with the second location; detecting a first sensor trigger using the first sensor; and determining that the first sensor trigger occurred at the second location.

In addition to one or more of the features described above, or as an alternative, further embodiments may include activating an alarm in response to the sensor trigger.

In addition to one or more of the features described above, or as an alternative, further embodiments may include: detecting a third wireless signal from a second sensor; determining a third signal strength of the third wireless signal, the third signal strength is equal to the first signal strength; associating the third signal strength of the third wireless signal with the first location; detecting a second sensor trigger using the second sensor; and determining that the second sensor trigger occurred at the first location.

In addition to one or more of the features described above, or as an alternative, further embodiments may include: transmitting the first sensor trigger to a notification device, the first sensor trigger is indicated to have occurred at the second location on the notification device.

In addition to one or more of the features described above, or as an alternative, further embodiments may include that the notification device is a mobile computing device.

In addition to one or more of the features described above, or as an alternative, further embodiments may include that the first wireless signal and the second wireless signal are infrared signals.

In addition to one or more of the features described above, or as an alternative, further embodiments may include: adjusting a sensor type of the first sensor in response to a change from the first location to the second location.

According to another embodiment, a security panel is provided. The security panel including: a processor; and a memory including computer-executable instructions that, when executed by the processor, cause the processor to perform operations, the operations including: detecting a first wireless signal from a first sensor; determining a first signal strength of the first wireless signal; associating the first signal strength of the first wireless signal with a first location; detecting a second wireless signal from the first sensor; determining a second signal strength of the second wireless signal; associating the second signal strength of the second wireless signal with the second location; detecting a first sensor trigger using the first sensor; and determining that the first sensor trigger occurred at the second location.

In addition to one or more of the features described above, or as an alternative, further embodiments may include that the operations further include: activating an alarm in response to the sensor trigger.

In addition to one or more of the features described above, or as an alternative, further embodiments may include that the operations further include: detecting a third wireless signal from a second sensor; determining a third signal strength of the third wireless signal, the third signal strength is equal to the first signal strength; associating the third signal strength of the third wireless signal with the first location; detecting a second sensor trigger using the second sensor; and determining that the second sensor trigger occurred at the first location.

In addition to one or more of the features described above, or as an alternative, further embodiments may include that the operations further include: transmitting the first sensor trigger to a notification device, the first sensor trigger is indicated to have occurred at the second location on the notification device.

In addition to one or more of the features described above, or as an alternative, further embodiments may include that the notification device is a mobile computing device.

In addition to one or more of the features described above, or as an alternative, further embodiments may include that the first wireless signal and the second wireless signal are infrared signals.

In addition to one or more of the features described above, or as an alternative, further embodiments may include that the operations further include: adjusting a sensor type of the first sensor in response to a change from the first location to the second location.

According to an embodiment, a computer program product tangibly embodied on a computer readable medium is provided. The computer program product including instructions that, when executed by a processor, cause the processor to perform operations including: detecting a first wireless signal from a first sensor; determining a first signal strength of the first wireless signal; associating the first signal strength of the first wireless signal with a first location; detecting a second wireless signal from the first sensor; determining a second signal strength of the second wireless signal; associating the second signal strength of the second wireless signal with the second location; detecting a first sensor trigger using the first sensor; and determining that the first sensor trigger occurred at the second location.

In addition to one or more of the features described above, or as an alternative, further embodiments may include that the operations further include: activating an alarm in response to the sensor trigger.

In addition to one or more of the features described above, or as an alternative, further embodiments may include that the operations further include: detecting a third wireless signal from a second sensor; determining a third signal strength of the third wireless signal, the third signal strength is equal to the first signal strength; associating the third signal strength of the third wireless signal with the first location; detecting a second sensor trigger using the second sensor; and determining that the second sensor trigger occurred at the first location.

In addition to one or more of the features described above, or as an alternative, further embodiments may include that the operations further include: transmitting the first sensor trigger to a notification device, the first sensor trigger is indicated to have occurred at the second location on the notification device.

In addition to one or more of the features described above, or as an alternative, further embodiments may include that the notification device is a mobile computing device.

In addition to one or more of the features described above, or as an alternative, further embodiments may include that the first wireless signal and the second wireless signal are infrared signals.

Technical effects of embodiments of the present disclosure include detecting a location of a sensor for a security system in response to a signal strength detected between the sensor and the security panel.

The foregoing features and elements may be combined in various combinations without exclusivity, unless expressly indicated otherwise. These features and elements as well as the operation thereof will become more apparent in light of the following description and the accompanying drawings. It should be understood, however, that the following description and drawings are intended to be illustrative and explanatory in nature and non-limiting.

BRIEF DESCRIPTION

The following descriptions should not be considered limiting in any way. With reference to the accompanying drawings, like elements are numbered alike:

DETAILED DESCRIPTION

A detailed description of one or more embodiments of the disclosed apparatus and method are presented herein by way of exemplification and not limitation with reference to the Figures.

Figure 1:
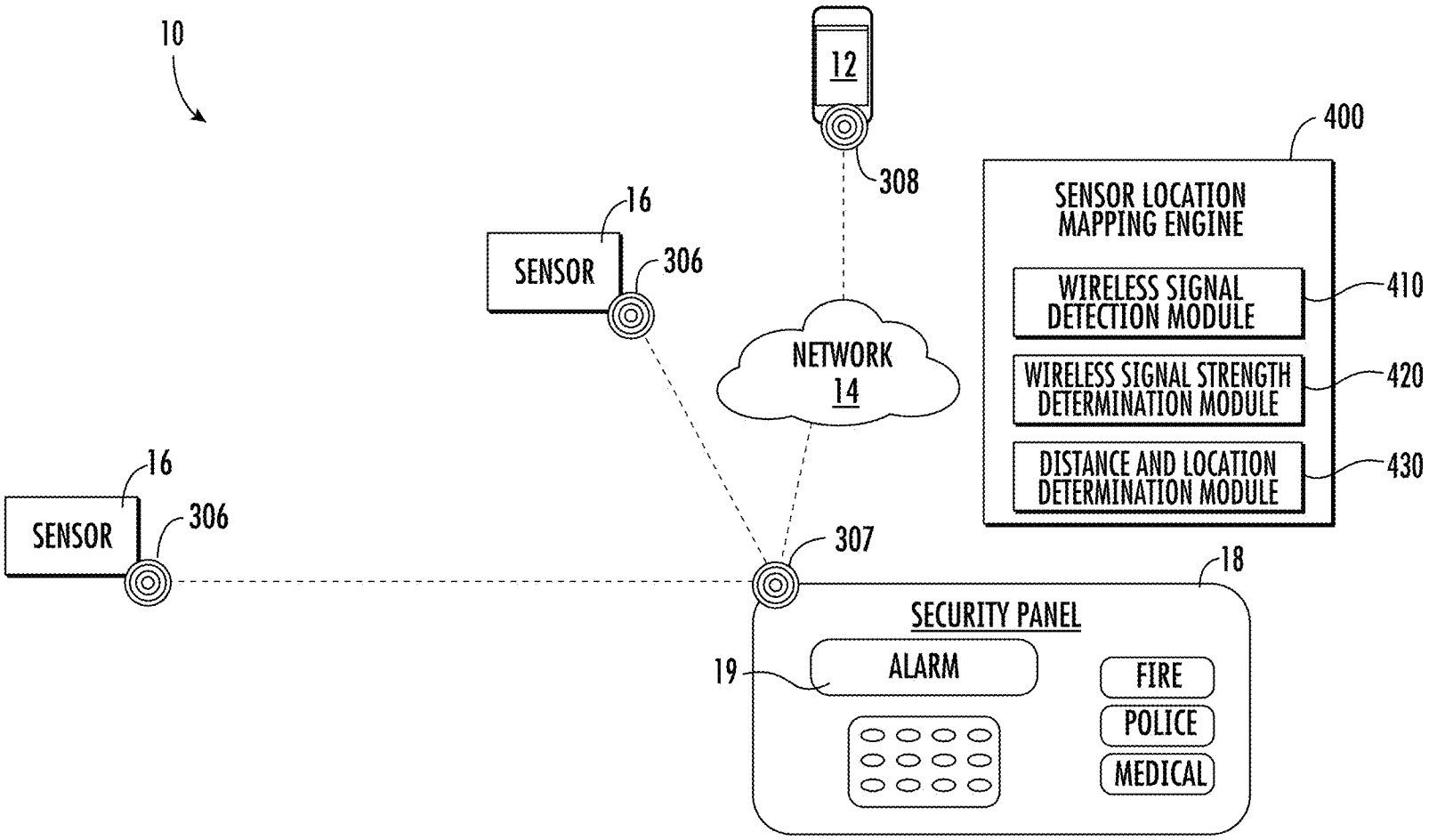
FIG. 1 illustrates a general schematic system diagram of a security system, in accordance with an embodiment of the disclosure.

FIG. 1 schematically illustrates a security system 10. The security system 10 generally includes one more sensors 16, a security panel 18, a notification device 12, and a network 14. The security system 10 may include any number of sensors 16. The sensors 16 may be configured to detect entry through or past an impediment or a particular area such as, for example, a property boarder, a fence gate, a bridge, a turnstile, a door, a garage door, a window, a wall, or other impediment/area known to one of skill in the art that may require security system. The sensors 16 may be configured to detect a sensor trigger, such as, for example, changes in light, changes in noise, changes in vibration, passage through a laser beam, change in temperature, or motion, in order to detect entry through or past an impediment or particular area. The sensors 16 may be multi-purpose sensors and thus may also detect other sensor triggers that may require attention such as, for example, smoke, fire, gas, and/or CO2. It should be appreciated that, although particular systems are separately defined in the schematic block diagrams, each or any of the systems may be otherwise combined or separated via hardware and/or software.

When the sensors 16 detect a sensor trigger, the sensor trigger is transmitted to the security panel 18. The security panel 18 may be a configured to activate an alarm 19 in response to a sensor trigger by the sensor 16. The security panel 18 may be configured to first analyze the sensor trigger to filter out false alarms prior to activating the alarm 19. The alarm 19 may be audible (e.g., a horn) and/or visual (e.g., flashing lights). The security panel 18 may be an electronic controller including a processor and an associated memory comprising computer-executable instructions that, when executed by the processor, cause the processor to perform various operations. The processor may be but is not limited to a single-processor or multi-processor system of any of a wide array of possible architectures, including field programmable gate array (FPGA), central processing unit (CPU), application specific integrated circuits (ASIC), digital signal processor (DSP) or graphics processing unit (GPU) hardware arranged homogenously or heterogeneously. The memory may be a storage device such as, for example, a random access memory (RAM), read only memory (ROM), or other electronic, optical, magnetic or any other computer readable medium. The security panel 18 may be configured to differentiate the sensor trigger between a "fire", "police", or "medical", in a few non-limiting examples.

The security panel 18 may also be configured to transmit the sensor trigger and/or alarm 19 to a notification device 12. The notification device 12 may be a dedicated device (i.e., baby monitor), a computing device such as a desktop computer, or a mobile computing device that is typically carried by a person, such as, for example a phone, PDA, smart watch, tablet, laptop, etc. The notification device 12 may also be two separate devices that are synced together such as, for example, a cellular phone and a desktop computer synced over an internet connection. The notification device 12 is a wireless device capable of communicating directly with the security panel 18 and/or through a network 14. The network 14 may be a cloud computing network.

Each sensor 16 is wireless-capable and configured to advertise a wireless signal 306. Any sensor trigger by the sensor 16 may be transmitted to the security panel 18 via the wireless signal 306. The sensor 16 may be configured to continuously advertise a wireless signal 306 or advertise the wireless signal 306 when prompted. In one example, the sensor 16 may advertise the wireless signal 306 manually by an installer setting up the security system 10. In a second example, the sensor 16 may advertise the wireless signal 306 when moved to a new location, which may be detected by an inertial measurement unit (IMU) internal to the sensor 16. In a third example, the sensor 16 may advertise the wireless signal 306 when the sensor 16 detects a sensor trigger. The wireless signal 306 may be infrared, short-range radio, long-range radio, Bluetooth, Wi-Fi, or any other wireless communication method known to one or skill in the art. In an embodiment, the wireless signal 306 may be infrared.

The system 10 may include a sensor location mapping engine 400 configured to determine relative location of each of the one or more sensors 16. The sensor location mapping engine 400 is comprised of modules including a wireless signal detection module 410; a wireless signal strength determination module 420; and a sensor distance and location determination module 430. Each module 410, 420, 430 may be located on at least one of the security panel 18, the sensors 16, or in the network 14. Alternatively, the modules 410, 420, 430 may be distributed among the security panel 18, the sensors 16, or in the network 14. In an embodiment, the sensor location mapping engine 400 is contained within the security panel 18.

The wireless signal detection module 410 is configured to detect a wireless signal advertised. In an embodiment, the wireless signal detection module 410 detects the wireless signal 306 advertised by each of the sensors 16 to the security panel 18. The wireless signal strength determination module 420 is configured to determine a wireless signal strength of each of the wireless signals detected. In an embodiment, the wireless signal strength is the signal strength of the wireless signal 306 advertised by each of the sensors 306 to the security panel 18. The wireless signal strength may be a received signal strength indicator (RSSI). The sensor distance and location determination module 430 is configured to determine a distance between the security panel 18 and each of the one or more sensors 16 in response to the signal strength 16. The sensor distance and location determination module 430 may determine a location of each sensor 16 in response to each signal strength. For example, a first signal strength/first distance may be associated with a baby room whereas a second signal strength/second distance may be associated with the front door. The association of a specific location with a specific distance may be established upon initial set up of the security system 10 and then periodically updated when the sensors 16 are moved.

The sensor distance and location determination module 430 may be configured to generate a map of the location of each sensor 16. In a few non-limiting example the map may be graphical, pictorial, or a coordinate matrix. The map may depict the sensors 16 relative to each other and/or may map the actual location of each sensor 16 within a building in a non-limiting example.

In an embodiment, the sensor location mapping engine 400 is located in the security panel 18 and the security panel 18 is configured to detect a wireless signal 306 of each sensor 16, determine a signal strength of each wireless signal 306, and then determine distance between the security panel 18 and each sensor 16 in response to each signal strength.

In an embodiment, the sensor location mapping engine 400 may be distributed among the sensors 16, the security panel 18, and/or the network 14. For example, the security panel 18 may be configured to advertise a wireless signal 307 and the sensors 16 may be configured to detect the wireless signal 307, then a distance is determined between the security panel 18 and each sensor 16 in response to a signal strength of the wireless signal 307. In another embodiment, each sensor 16 may detect the wireless signal 307, then pass this information off to security panel 18 via the network 14 to determine a strength of the wireless signals 307, and the approximate distance between the security panel 18 and each sensor 16.

Advantageously, determining the location of the each sensor in response to signal strength allows the security system 10 to be installed and reorganized with increased speed and accuracy because the location of each sensor 16 is determined automatically.

Figure 2:
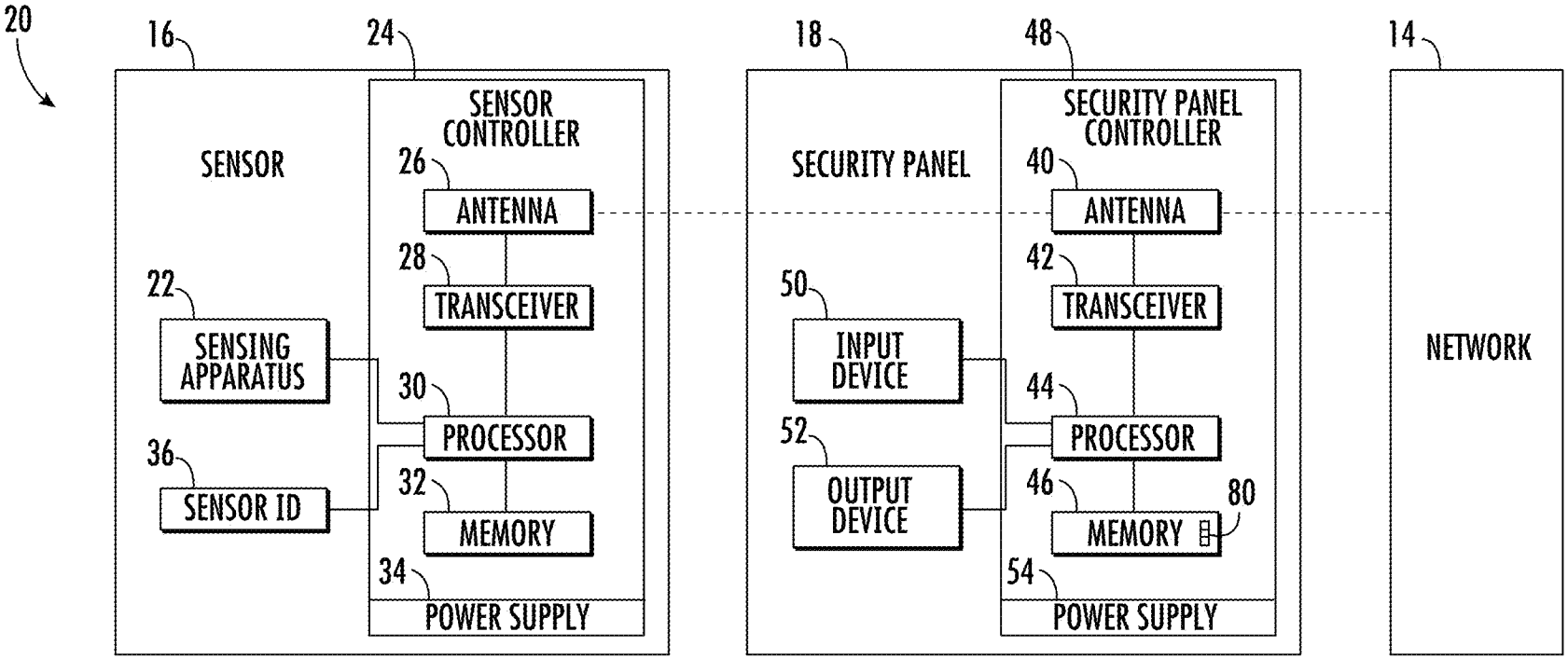
FIG. 2 illustrates a block diagram of a sensor, a security panel, and a network of the security system of FIG. 1, in accordance with an embodiment of the disclosure.

Referring now to FIG. 2 with continued reference to FIG. 1. FIG. 2 shows a block diagram of an example electronic sensor system 20 including the sensor 16, the security panel 18, and the network 14. The sensor 16 generally includes a sensing apparatus, a sensor controller 24, a sensor antenna 26, a sensor transceiver 28, a sensor processor 30, a sensor memory 32, a sensor power supply 34, and a sensor ID 36. The sensor ID 36 may be a serial number or credential that identifies one sensor 16 from another sensor 16.

The sensing apparatus 22 may be a device configured to detect changes in light, changes in noise, changes in vibration, passage through a laser beam, change in temperature, smoke, fire, gas and/or $CO_2$, as discussed above. The sensing apparatus 22 may contain an IMU sensor to detect acceleration of the sensor 16 or any derivative or integral of acceleration, such as, for example, velocity, jerk, jounce, etc. The sensing apparatus may also contain magnetic contact sensors, freeze sensors, water level sensor, proximity sensor, passive infrared (PIR) Image sensor and shock sensitive (glass break) sensor.

The sensor transceiver 28 is capable of transmitting and receiving data to and from at least the security panel 18 and the network 14. The sensor transceiver 28 may, for instance, be a near field communication (NFC), Bluetooth, infrared, ZigBee, or Wi-Fi transceiver, or another appropriate wireless transceiver. The sensor antenna 26 is any antenna appropriate to the sensor transceiver 28. The sensor processor 30 and sensor memory 32 are, respectively, data processing, and storage devices. The sensor processor 30 may, for instance, be a microprocessor that can process instructions and analyze data detected by the sensing apparatus 22. The sensor memory 32 may be RAM, EEPROM, or other storage medium where the sensor processor 30 can read and write data including but not limited to sensor configuration options. The sensor power supply 34 is a power source such as line power connection, a power scavenging system, or a battery that powers the sensor controller 24.

The security panel 18 generally includes a controller 48, an antenna 40, a transceiver 42, a processor 44, a memory 46, an input device 50, an output device 52, and a power supply 54. The transceiver 42 is a transceiver of a type corresponding to the sensor transceiver 28, and the antenna 40 is a corresponding antenna. In some embodiments, the transceiver 42 and the antenna 40 may also be used to communicate with the network 14. In other embodiments, one or more separate transceivers and antennas may be included to communicate with network 14. The security panel 18 may also include an application 80, such as, for example, the sensor location mapping engine 400. Embodiments disclosed herein, may operate through the mobile device application 80 installed on the security panel 18. The sensor power supply 54 is a power source such as line power connection, a power scavenging system, or a battery that powers the controller 48.

Figure 3:
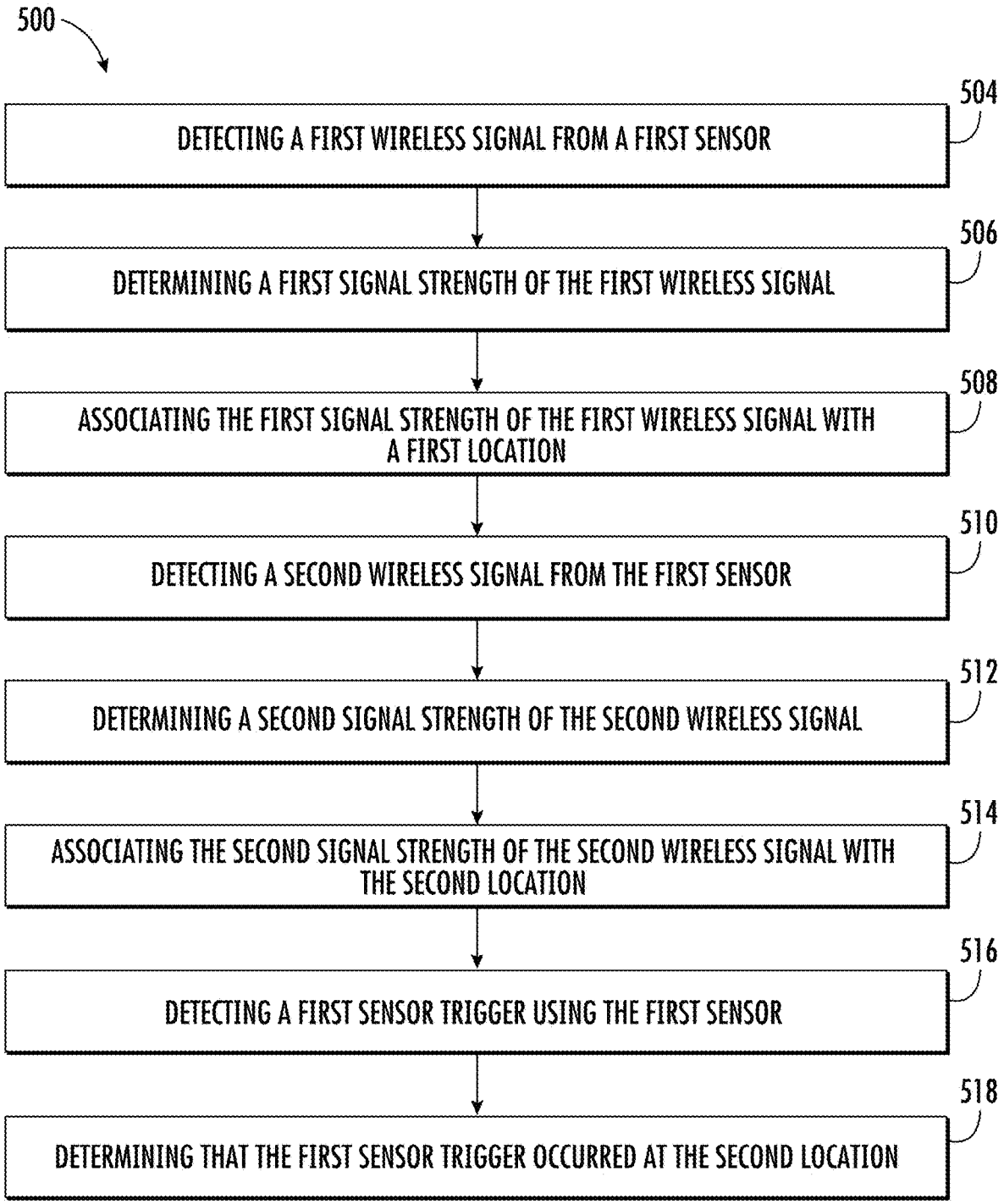
FIG. 3 is a flow diagram illustrating a method of determining a location of one or more sensors in a security system, according to an embodiment of the present disclosure.

Referring now to FIG. 3 with continued reference to FIGS. 1-2. FIG. 3 shows a flow chart of a method 500 of determining a location of one or more sensors 16 utilizing in a security system 10. In an embodiment, the method 500 is performed by the security panel 18. At block 504, a first wireless signal 306 from a first sensor 16 detected. At block 506, a first signal strength of the first wireless signal 306 is determined. At block 508, the first signal strength of the first wireless signal 306 is associated with a first location. Block 508 may be done manually upon initially set up of the security system 10. At block 510, a second wireless signal 306 is detected from the first sensor 16. At block 512, a second signal strength of the second wireless signal 306 is determined. At block 514, the second signal strength of the second wireless signal 306 is associated with the second location. The first sensor 16 may be comprised of one or more sensing capabilities to trigger different alarms referring to different sensor type (i.e., fire, gas, vibration, change in light, etc), thus if the location of the sensor 16 is changed from a first location to a second location then the security panel 18 may configure the sensor 16 to a different sensing capability (e.g., sensor type) in response to the location of the sensor. In an embodiment, a sensor type of the first sensor 16 may be adjusted in response to a change from the first location to a second location.

The second signal strength of the second wireless signal 306 may be different than the first signal strength of the first wireless signal 306, which indicates that the first sensor 16 has been moved. At block 516, a first sensor trigger using the first sensor 16 is detected. At block 518, it is determined that the first sensor trigger occurred at the second location. An alarm 19 may be activated in response to the sensor trigger. The first sensor trigger may be transmitted to a notification device 12. The first sensor trigger is indicated to have occurred at the second location on the notification device 12. In an embodiment, the notification device 12 may be a mobile computing device, such as, for example a smart phone. In another embodiment, the first wireless signal and the second wireless signal are infrared signals.

The method 500 may further include: detecting a third wireless signal 306 from a second sensor 16 and if the third signal strength of the third wireless signal 306 is equal to the first signal strength then the third signal strength of the third wireless signal 306 is associated with the first location. Thus, when a second sensor trigger is detected using the second sensor 16, it may be determined that the second sensor trigger occurred at the first location.

While the above description has described the flow process of FIG. 3 in a particular order, it should be appreciated that unless otherwise specifically required in the attached claims that the ordering of the steps may be varied.

As described above, embodiments can be in the form of processor-implemented processes and devices for practicing those processes, such as a processor. Embodiments can also be in the form of computer program code containing instructions embodied in tangible media, such as network cloud storage, SD cards, flash drives, floppy diskettes, CD ROMs, hard drives, or any other computer-readable storage medium, wherein, when the computer program code is loaded into and executed by a computer, the computer becomes a device for practicing the embodiments. Embodiments can also be in the form of computer program code, for example, whether stored in a storage medium, loaded into and/or executed by a computer, or transmitted over some transmission medium, loaded into and/or executed by a computer, or transmitted over some transmission medium, such as over electrical wiring or cabling, through fiber optics, or via electromagnetic radiation, wherein, when the computer program code is loaded into an executed by a computer, the computer becomes an device for practicing the embodiments. When implemented on a general-purpose microprocessor, the computer program code segments configure the microprocessor to create specific logic circuits.

The term "about" is intended to include the degree of error associated with measurement of the particular quantity based upon the equipment available at the time of filing the application. For example, "about" can include a range of ±8% or 5%, or 2% of a given value.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

While the present disclosure has been described with reference to an exemplary embodiment or embodiments, it will be understood by those skilled in the art that various changes may be made and equivalents may be substituted for elements thereof without departing from the scope of the present disclosure. In addition, many modifications may be made to adapt a particular situation or material to the teachings of the present disclosure without departing from the essential scope thereof. Therefore, it is intended that the present disclosure not be limited to the particular embodiment disclosed as the best mode contemplated for carrying out this present disclosure, but that the present disclosure will include all embodiments falling within the scope of the claims.

What is claimed is:

1. A method of determining a location of one or more sensors in a security system, the method comprising:
- detecting a first wireless signal from a first sensor;
- determining a first signal strength of the first wireless signal;
- associating the first signal strength of the first wireless signal with a first location;
- detecting a second wireless signal from the first sensor;
- determining a second signal strength of the second wireless signal;
- associating the second signal strength of the second wireless signal with the second location;
- detecting a first sensor trigger using the first sensor; and
- determining that the first sensor trigger occurred at the second location, wherein the method further comprises at least one of:
  - (1) adjusting a sensor type of the first sensor in response to a change from the first location to the second location; or
  - (2) detecting a third wireless signal from a second sensor;
    - determining a third signal strength of the third wireless signal, wherein
    - the third signal strength is equal to the first signal strength;
    - associating the third signal strength of the third wireless signal with the first location;
    - detecting a second sensor trigger using the second sensor; and
    - determining that the second sensor trigger occurred at the first location.

2. The method of claim 1, further comprising:
activating an alarm in response to the sensor trigger.

3. The method of claim 1, further comprising:
transmitting the first sensor trigger to a notification device, wherein the first sensor trigger is indicated to have occurred at the second location on the notification device.

4. The method of claim 3, wherein:
the notification device is a mobile computing device.

5. The method of claim 1, wherein:
the first wireless signal and the second wireless signal are infrared signals.

6. A security panel comprising:

a processor; and a memory comprising computer-executable instructions that, when executed by the processor, cause the processor to perform operations, the operations comprising:

detecting a first wireless signal from a first sensor;

determining a first signal strength of the first wireless signal;

associating the first signal strength of the first wireless signal with a first location;

detecting a second wireless signal from the first sensor;

determining a second signal strength of the second wireless signal;

associating the second signal strength of the second wireless signal with the second location;

detecting a first sensor trigger using the first sensor; and determining that the first sensor trigger occurred at the second location, wherein the operations further comprise at least one of:

(1) adjusting a sensor type of the first sensor in response to a change from the first location to the second location; or (2) detecting a third wireless signal from a second sensor;

determining a third signal strength of the third wireless signal, wherein the third signal strength is equal to the first signal strength;

associating the third signal strength of the third wireless signal with the first location;

detecting a second sensor trigger using the second sensor; and determining that the second sensor trigger occurred at the first location.

7. The security panel of claim 6, wherein the operations further comprise:

activating an alarm in response to the sensor trigger.

8. The security panel of claim 6, wherein the operations further comprise:

transmitting the first sensor trigger to a notification device, wherein the first sensor trigger is indicated to have occurred at the second location on the notification device.

9. The security panel of claim 8, wherein:

the notification device is a mobile computing device.

10. The security panel of claim 6, wherein:

the first wireless signal and the second wireless signal are infrared signals.

11. The security panel of claim 6, wherein the operations further comprise:

adjusting a sensor type of the first sensor in response to a change from the first location to the second location.

12. A computer program product tangibly embodied on a non-transitory computer readable medium, the computer program product including instructions that, when executed by a processor, cause the processor to perform operations comprising:

detecting a first wireless signal from a first sensor;

determining a first signal strength of the first wireless signal;

associating the first signal strength of the first wireless signal with a first location;

detecting a second wireless signal from the first sensor;

determining a second signal strength of the second wireless signal;

associating the second signal strength of the second wireless signal with the second location;

detecting a first sensor trigger using the first sensor; and determining that the first sensor trigger occurred at the second location, wherein the method further comprises at least one of:

(1) adjusting a sensor type of the first sensor in response to a change from the first location to the second location; or (2) detecting a third wireless signal from a second sensor;

determining a third signal strength of the third wireless signal, wherein the third signal strength is equal to the first signal strength;

associating the third signal strength of the third wireless signal with the first location;

detecting a second sensor trigger using the second sensor; and determining that the second sensor trigger occurred at the first location.

13. The computer program product of claim 12, wherein the operations further comprise:

activating an alarm in response to the sensor trigger.

14. The computer program product of claim 12, wherein the operations further comprise:

transmitting the first sensor trigger to a notification device, wherein the first sensor trigger is indicated to have occurred at the second location on the notification device.

15. The computer program product of claim 14, wherein:

the notification device is a mobile computing device.

16. The computer program product of claim 12, wherein:

the first wireless signal and the second wireless signal are infrared signals.

* * * * *